United States Patent [19]

Rottensteiner

[11] 4,306,341

[45] Dec. 22, 1981

[54] EXTERNALLY HELD CYLINDRICAL SPREADING MEANS FOR TUBULAR FABRIC

[75] Inventor: Hans Rottensteiner, Schwarzach, Austria

[73] Assignee: Lindauer Dornier Gesellschaft mbH, Fed. Rep. of Germany

[21] Appl. No.: 153,097

[22] Filed: May 27, 1980

[30] Foreign Application Priority Data

Jun. 28, 1979 [DE] Fed. Rep. of Germany ..... 2926117

[51] Int. Cl.[3] ..... D06C 5/00

[52] U.S. Cl. ..... 26/85

[58] Field of Search ..... 26/80, 83, 84, 85; 264/290.2

[56] References Cited

U.S. PATENT DOCUMENTS 4,192,045 3/1980 Frezza ..... 26/84 X

FOREIGN PATENT DOCUMENTS 43-20394 9/1968 Japan ..... 26/83
49-6543 2/1974 Japan ..... 264/290.2
463275 3/1937 United Kingdom ..... 26/83
940339 10/1963 United Kingdom ..... 26/85
2035404 6/1980 United Kingdom ..... 26/85

*Primary Examiner*—Robert Mackey
*Attorney, Agent, or Firm*—James E. Bryan

[57] ABSTRACT

This invention relates to an improvement in an externally held cylindrical spreading means for tubular fabric, particularly for the treatment of the fabric with a fluid treating agent, with a central carrier for radially displaceable supports and segment-like guide elements carried by the supports, body means at each end of the central carrier, each of the body means being tapered in the longitudinaL direction, and the guide elements extending in the longitudinal direction of the spreading means between the body means, the improvement comprising pneumatic drive means within the spreading means connected to sleeve means on the central carrier, the sleeve means being connected to the radially displaceable supports and being displaceable on the central carrier, compressed air junction means in at least one of the guide elements and having a back pressure valve means therein, and means connecting the compressed air junction means with the pneumatic drive means. The invention also includes an embodiment in which the sleeve means are threaded and are mounted on opposite threads on a central carrier, also further including reversible compressed air motor means connected to the central carrier whereby the latter may be rotated.

6 Claims, 4 Drawing Figures

EXTERNALLY HELD CYLINDRICAL SPREADING MEANS FOR TUBULAR FABRIC

Figure 2:
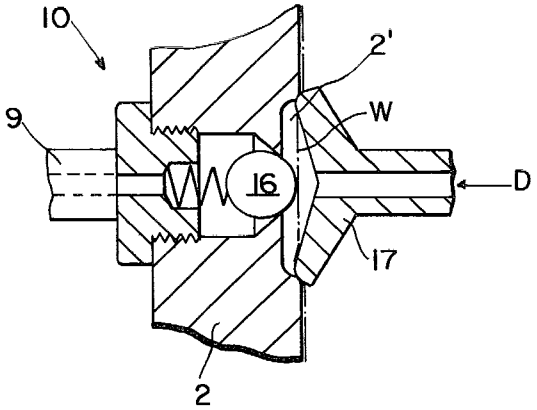

Copending application Ser. No. 092,100, filed Nov. 7, 1979, relates to an externally held cylindrical spreading means for tubular fabric with a central carrier for radially displaceable supports and segment-like guide elements carried by the supports, in particular for treating the fabric with a fluid treating agent. Bodies tapering in the longitudinal direction are mounted to the ends of the central carrier and act as retraction and extension means and between which the guide elements are arranged in the longitudinal direction of the spreading means. Furthermore, supporting and transporting rollers rest against these bodies, the supporting and transporting rollers having profiles adapted to the form of the tapered bodies.

In order to keep the fabric tensioned during operation, the spreading means diameter must be adapted to the particular fabric being treated. The copending application, supra, discloses a simple embodiment permitting manual widening of the spreading means. To that end the central carrier is provided at the top and bottom with threads in mutually opposite directions and on which are seated threaded sleeves in such a manner that by rotating the carrier the threaded sleeves can be brought closer or separated from each other along the mutually opposite threads. Movably supported levers extend radially obliquely outwardly from these threaded sleeves to the longitudinal guide elements of the spreading means. When the carrier is rotated, the threaded sleeves are displaced and thereby the guide elements are moved more or less outwardly or inwardly and hence the spreading means thereby will be widened or narrowed. The rotation of the carrier takes place manually in the apparatus of the copending application, supra, by hand wheels mounted at the ends of the tapered bodies.

The handwheels for adjusting the spreading means can be easily rotated only when no fabric as yet is being pulled over the spreading means. Accordingly, spreading means adjustment essentially must be made prior to the introduction of the fabric. This circumstance is a drawback in operation, and therefore it is the object of the invention to so improve the spreading means described in the copending application, supra, that its widening is also possible after the fabric has been introduced. This problem is solved by the invention using pneumatic drive means inside the spreading means coupled by the longitudinally adjustable sleeves to the levers and to at least one compressed air supply junction arranged in a countersunk manner in a guide element and provided with a back pressure valve. The required compressed air can be easily obtained by a loose connecting conduit segment fitting on the externally located compressed air supply junction. As the compressed air passes without impediment through the fabric to the junction at the guide elements of the spreading means, the widening of the spreading means can be implemented externally at any time. The adjustability of the spreading means by pneumatic means can be carried out in various ways. Two possibilities are stated below.

Figure 3:
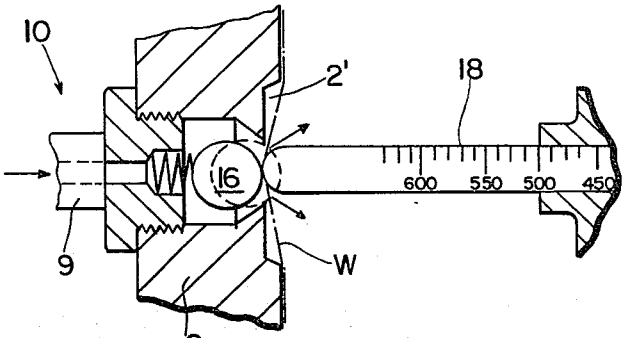
Figure 1:
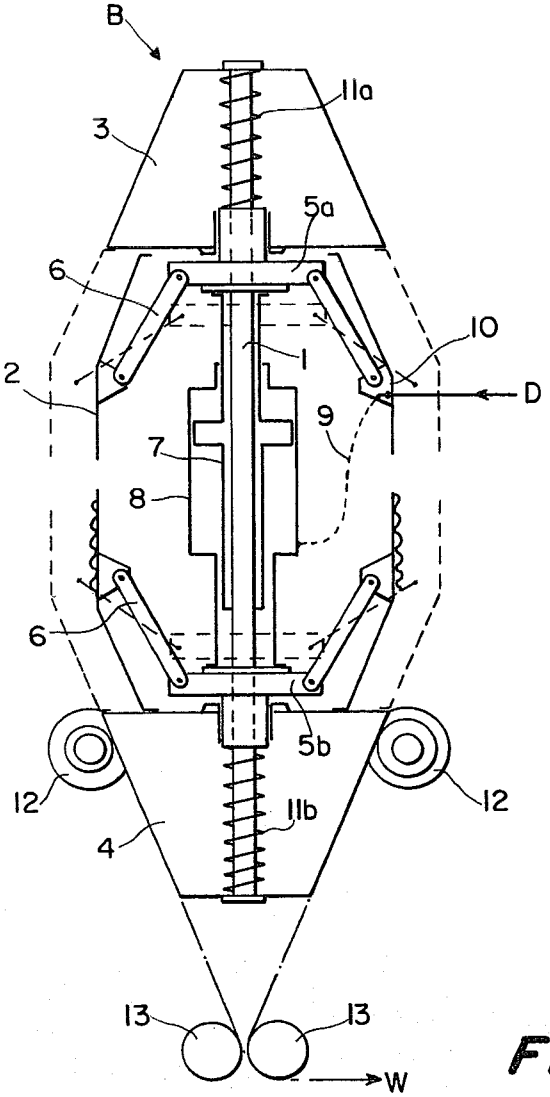
Figure 4:
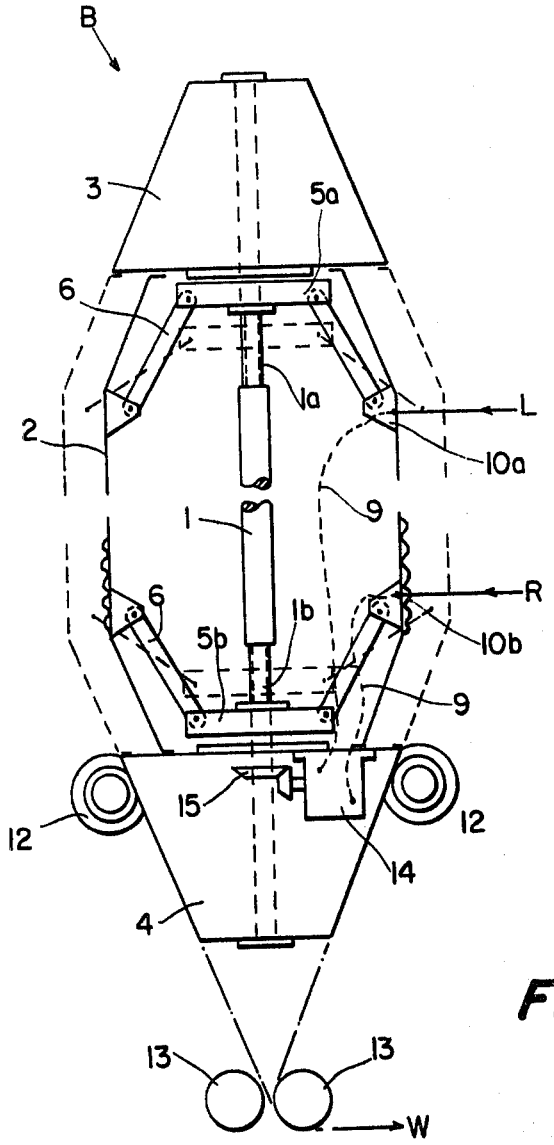

Embodiments of the invention are described below in relation to the drawings, in which:

FIG. 1 is a pneumatic adjusting means using a piston and cylinder for the spreading means, FIG. 2 is a detail from FIG. 1, FIG. 3 is a further detail from FIG. 1, and FIG. 4 is a pneumatic adjusting means using a compressed air motor for the spreading means.

The spreading means B shown in FIG. 1 is of the type described in the copending application, supra. A central carrier 1 terminates at both its ends by the tapered retraction or extension bodies 3 or 4, respectively. Guide elements 2 extend between the two tapered bodies 3 and 4. These guide elements are shown in solid lines for the retracted position and in phantom for the extended position of the spreading means. All of the spreading means B is supported by the supporting and transporting rollers 12 which are braced against the body 4. The path of the fabric is shown in dash-dot manner at the geometric extension of the tapered body 4. It is taken off by means of the pair of discharge rollers 13 in the direction shown by the arrow. The guide elements 2 are connected in hinged manner by means of support levers 6 with the displaceable sleeves 5*a* or 5*b*.

The sleeves 5*a* and 5*b* are axially displaceable on the carrier 1 against the spring force of the terminal springs 11*a* and 11*b*. In the embodiment shown, the springs act in such a manner that the guide elements 2 will move into the widened position shown in dashed lines. The central carrier 1 is surrounded in concentric manner by two tubes 7 and 8 which telescope with respect to each other. The tube 7 is mounted to sleeve 5*a* and tube 8 to sleeve 5*b*. At the center, the telescoped tubes 7 and 8 form a piston and cylinder and are biased apart by the supply of compressed air D through a supply conduit 9 against the return force of the springs 11*a* and 11*b*. Therefore, the spreading means assumes the position of its guide elements 2 shown in solid lines under the effect of the compressed air. The guide elements 2 then are in their innermost narrowed position. When the compressed air escapes from the piston-cylinder system, the springs 11*a* and 11*b* induce a widening of the spreading means into the position shown in dashed lines. The supply conduit 9 for the compressed air is flexible and extends from the outer tube 8 to a supply junction 10 at one guide element 2. Compressed air D can be supplied externally, in a manner further described below, to this supply junction 10.

FIG. 2 shows the compressed air junction 10 on a larger scale. The cross-section shows part of the wall of a guide element 2. The compressed air junction is located in a small recess 2' of the guide element. The junction contains a back pressure valve 16 to which the flexible conduit 9 is connected. A mouth means of a conduit 17 can be loosely set on the junction, similar to the case of a vehicle air tire. The arrows indicate the path of the compressed air into the inside of the spreading means. A dash-dot line furthermore indicates the position of the fabric W. It is located on the outside of the guide elements 2 and also covers the recess 2' of the junction 10, and therefore extends between the mouth means 17 and the back pressure valve 16. Because the fabric W is permeable to the supplied compressed air, the spreading means also can be adjusted when the fabric is inserted and compressed air is used. Continuous adjustment or adaptation of the diameter of the spreading means to the particular fabric to be treated is possible on account of the supply or escape of the compressed air.

FIG. 3 also shows a junction 10 on a larger scale. It is the same design as in FIG. 2. However in this instance it is not the supply but the discharge of compressed air which is shown. A sensor 18 provides the means for depressing the ball of the back pressure valve 16, whereby the compressed air can be exhausted in the direction of the arrow. The spreading means then is widened in the manner above. The sensor 18 is mounted outside the spreading means in a manner not further described and is displaceable with respect to the spreading means in the radial direction. It moves for instance against a spring force in an automatic manner as the diameter of the spreading means varies. Advantageously, the sensor includes graduations showing the diameter of the spreading means. According to the embodiment illustrated in FIG. 3, the desired size would be reached for a diameter of 500 mm and the operator(s) might then close the back pressure valve 16. Obviously the procedure indicated here also can be automated.

The spreading means B shown in FIG. 4 in principle is of the same design as that of FIG. 1. It also comprises guide elements connected by levers to sleeves. Differently from the case for FIG. 1, the sleeves here are not axially displaceable in sliding manner, rather they are designed as threaded sleeves 5*a* and 5*b*. The sleeves are seated on oppositely winding threads 1*a* and 1*b* of the central carrier 1. The central carrier 1 is rotated in order to displace the threaded sleeves 5*a* and 5*b*. Here again the rotation takes place using compressed air, namely a compressed air motor and gearing 15. Again, the compressed air motor 14 is connected by flexible supply conduits 9 with the junctions 10*a* and 10*b* on the outside of the guide elements 2. Junction 10*a* for instance receives compressed air for displacement to the left L and junction 10*b* receives compressed air for displacement to the right R of the compressed air motor 14 as indicated by the direction of the arrows. The design of the junctions 10*a* and 10*b* corresponds entirely to that of FIG. 2.

It will be obvious to those skilled in the art that many modifications may be made within the scope of the present invention without departing from the spirit thereof, and the invention includes all such modifications.

What I claim is:

1. In an externally held cylindrical spreading means for tubular fabric, a central carrier, radially displaceable supports connected to said central carrier and segment-like guide elements carried by the supports, body means at each end of the central carrier, each of said body means being tapered in the longitudinal direction, and said guide elements extending in the longitudinal direction of said spreading means between said body means, the improvement comprising pneumatic drive means within said spreading means, sleeve means on said central carrier connected to said pneumatic drive means, said sleeve means being connected to said radially displaceable supports and being displaceable on said central carrier, compressed air junction means in at least one of said guide elements and having a back pressure valve means therein, and means connecting said compressed air junction means with said pneumatic drive means.

2. A spreading means according to claim 1 in which said pneumatic drive means includes a piston-cylinder means connecting said sleeve means, whereby said sleeve means are displaceable in opposite directions by compressed air.

3. A spreading means according to claim 2 including return spring means on said central carrier acting in a spreading manner on said radially displaceable supports and guide elements.

4. A spreading means according to claims 1 or 2 including sensor means adapted to act externally against said back pressure valve means, and having means for indicating the diameter of said spreading means.

5. A spreading means according to claim 1 in which said sleeve means includes a pair of threaded sleeves mounted on opposite threads on said central carrier, and wherein said pneumatic drive means comprise reversible compressed air motor means connected to said central carrier and to said compressed air junction connecting means, whereby the latter may be rotated.

6. A spreading means according to claim 1 including means mounting said compressed air motor means in a cavity of one of said tapered body means.

* * * * *

UNITED STATES PATENT AND TRADEMARK OFFICE

CERTIFICATE OF CORRECTION

PATENT NO. : 4,306,341

DATED : December 22, 1981

INVENTOR(S) : Hans Rottensteiner

It is certified that error appears in the above—identified patent and that said Letters Patent is hereby corrected as shown below:

Column 4, line 1 of Claim 6, "claim 1" should read - - - claim 5 - - -.

Signed and Sealed this

*Sixth* Day of *April 1982*

[SEAL]

*Attest:*

GERALD J. MOSSINGHOFF

*Attesting Officer* *Commissioner of Patents and Trademarks*